US006517416B1

(12) United States Patent
Crevasse et al.

(10) Patent No.: US 6,517,416 B1
(45) Date of Patent: Feb. 11, 2003

(54) CHEMICAL MECHANICAL POLISHER INCLUDING A PAD CONDITIONER AND A METHOD OF MANUFACTURING AN INTEGRATED CIRCUIT USING THE CHEMICAL MECHANICAL POLISHER

(75) Inventors: Annette Margaret Crevasse, Apopka, FL (US); William Graham Easter, Orlando, FL (US); John Albert Maze, III, Clermont, FL (US); Frank Miceli, Orlando, FL (US)

(73) Assignee: Agere Systems Inc., Allentown, PA (US)

( * ) Notice: Subject to any disclaimer, the term of this patent is extended or adjusted under 35 U.S.C. 154(b) by 0 days.

(21) Appl. No.: 09/477,833

(22) Filed: Jan. 5, 2000

(51) Int. Cl.[7] ..... B24B 1/00
(52) U.S. Cl. ..... 451/41; 451/444
(58) Field of Search ..... 451/41, 56, 443, 451/444

(56) References Cited

U.S. PATENT DOCUMENTS 5,154,021 A * 10/1992 Bombardier et al. ..... 451/444
5,168,671 A * 12/1992 Kataoka et al. ..... 125/11.01
5,531,635 A * 7/1996 Mogi et al. ..... 451/443
5,578,529 A 11/1996 Mullin et al. ..... 437/228
5,611,943 A 3/1997 Cadien ..... 216/88
5,616,069 A * 4/1997 Walker et al. ..... 134/153
5,702,563 A 12/1997 Salugsugan et al. ..... 156/636.1
5,716,264 A * 2/1998 Kimura et al. ..... 451/285
5,779,522 A * 7/1998 Walker et al. ..... 134/143
5,868,608 A 2/1999 Allman et al. ..... 451/72
5,957,757 A 9/1999 Berman et al. ..... 451/56
5,967,757 A * 10/1999 Gunn et al. ..... 417/34
6,012,968 A * 1/2000 Lofaro ..... 451/39
6,099,393 A * 8/2000 Katagiri et al. ..... 451/444
6,139,406 A * 10/2000 Kennedy et al. ..... 451/28
6,149,508 A * 11/2000 Vanell et al. ..... 451/444
6,241,587 B1 * 6/2001 Drill et al. ..... 451/56
6,341,997 B1 * 1/2002 Lin ..... 134/19

OTHER PUBLICATIONS

European Standard Search Report—Dated: Jul. 30, 2001.

* cited by examiner

*Primary Examiner*—M. Rachuba
(74) *Attorney, Agent, or Firm*—Anthony Grillo

(57) ABSTRACT

A method of manufacturing a semiconductor device employing a polishing pad conditioner that directs a fluid stream at a polishing pad to remove accumulated material from the pad. The fluid stream may contact a large area of the polishing pad or a smaller area where the fluid stream is moved to condition different areas of the polishing pad. The fluid stream may include abrasive particles to promote the removal of the accumulated materials. The velocity of the fluid stream may be increased or decreased to promote removal of the accumulated materials. In yet another embodiment, the present invention is directed to a process for manufacturing an integrated circuit using a CMP process where the pad has been conditioned using the fluid stream. The present invention is also directed to a chemical mechanical planarization system including a pad conditioner.

20 Claims, 3 Drawing Sheets

CHEMICAL MECHANICAL POLISHER INCLUDING A PAD CONDITIONER AND A METHOD OF MANUFACTURING AN INTEGRATED CIRCUIT USING THE CHEMICAL MECHANICAL POLISHER

TECHNICAL FIELD OF THE INVENTION

The present invention is directed, in general, to integrated circuits and, more specifically, to a chemical mechanical planarization system including a pad conditioner and a method of making integrated circuits using the chemical mechanical planarization system.

BACKGROUND OF THE INVENTION

Chemical mechanical planarization (CMP) is an essential process in the manufacture of semiconductor chips today and is becoming more critical as device sizes continue to shrink into the lower submicron ranges. During CMP, the combination of chemical etching and mechanical abrasion produces a flat, precise surface for subsequent depositions of materials and photolithography steps. The polishing pad for CMP is usually made of polyurethane and has small pores to carry the slurry under the wafer. As a result of the polishing process, pad material and slurry residues collect in the pores, plugging them, and reducing the polish rate due to slurry starvation. This also causes the pad to glaze making the surface of the pad smooth. When the pad becomes clogged or glazed, it becomes necessary to "condition" the pad to restore its full functionality. That is, the accumulated material is removed before it completely clogs or glazes the pad.

In many conventional processes, a conditioning wheel comprised of a nickel-chromium alloy with a surface of embedded diamond abrasives is used to condition the pad. The conditioning wheel is pressed against the polishing pad by a conditioning wheel actuator; e.g., a hydraulic arm, and the pad and conditioning wheel are rotated while de-ionized water is flowed to rinse away abraded material. The diamond elements remove embedded particles, slurry, and polishing by-products from the polishing pad. The conditioning proceeds until the pad is "re-surfaced" and new pores are exposed.

Conventionally, the conditioning wheel may take various forms: e.g., an annular ring about the carrier head of the chemical mechanical planarization system, nylon brushes, buttons, or a solid planar surface. Establishing and maintaining precise planarity of the conditioning surface as the diamonds wear and break off is a well-known problem that is exaggerated by the small conditioning area (the contact area between the conditioning wheel and the polishing pad). Because the conditioning wheel surface area is only a small fraction of the polishing pad surface area, the conditioning wheel must be moved back and forth over the polishing pad in order to condition the entire pad. This results in local conditioning of the pad. Local conditioning of the pad is a function of conditioning time, the pressure and velocity of the conditioning wheel, and the wear of the conditioning wheel. As a result, conditioning can vary across the polishing pad. Consistency of the polishing environment is, however, a high priority in order to maintain an extremely precise CMP processes from wafer to wafer.

Accordingly, what is needed in the art is an apparatus and method of use that avoids the limitations of the prior art described above.

SUMMARY OF THE INVENTION

To address the above-discussed deficiencies of the prior art, the present invention provides a method of manufacturing a semiconductor device employing a polishing pad conditioner that directs a conditioning fluid stream at a polishing pad to remove accumulated material from the pad. The conditioning fluid stream may contact a large area of the polishing pad or a smaller area where the conditioning fluid stream is moved to condition different areas of the polishing pad. The conditioning fluid stream may include abrasive particles to promote the removal of the accumulated materials. The velocity of the conditioning fluid stream may be increased or decreased to promote removal of the accumulated materials. In yet another embodiment, the present invention is directed to a process for manufacturing an integrated circuit using a CMP process where the pad has been conditioned using the conditioning fluid stream. The present invention is also directed to a chemical mechanical planarization system including a pad conditioner.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 1A:
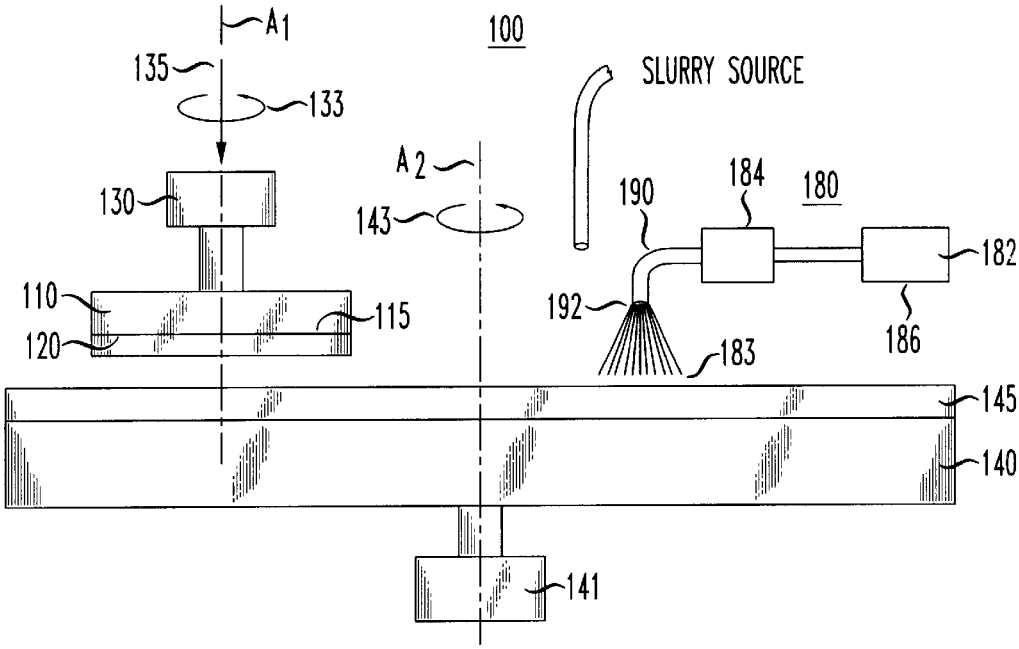
FIG. 1A is a schematic sectional view of an exemplary embodiment of a chemical mechanical planarization (CMP) apparatus according to an illustrative embodiment of the present invention.

The present invention provides a unique chemical mechanical planarization (CMP) pad conditioner that can remove accumulated material from the polishing pad. The pad conditioner utilizes a conditioning fluid stream directed towards the polishing pad to remove the accumulated materials. The velocity of the fluid stream may be increased or decreased to promote removal of the accumulated materials. The spray area of the conditioning fluid stream may be adjusted to condition a large area of the polishing pad at one time or a smaller area. The fluid stream may include abrasive particles to promote the removal of the accumulated materials.

Thus, in a broad scope, the present invention provides a pad conditioner that removes accumulated particles over an increased surface area as compared to conventional conditioning rings. Due to this increased surface area, the conditioning is spread out over a larger area of the polishing pad, which provides for a more consistent conditioning of the pad with fewer variations in the polishing pad's surface. Further, the composition of the conditioning fluid can be maintained at a steady state to make conditioning more consistent. This more consistent conditioning, in turn, provides for a more consistent and controlled polishing action on the semiconductor's targeted surface.

The targeted surfaces include, for example, planarizing: (a) insulator surfaces, such as silicon oxide or silicon nitride, deposited by chemical vapor deposition; (b) insulating layers, such as glasses deposited by spin-on and reflow deposition methods or CVD, over semiconductor devices; or (c) metallic conductor interconnection wiring layers.

Referring initially to FIG. 1, illustrated is a schematic sectional view of an exemplary embodiment of a chemical mechanical planarization (CMP) apparatus. The CMP apparatus 100 may be of a conventional design that includes a wafer carrier or polishing head 110 for holding a substrate or semiconductor wafer 120. The wafer carrier 110 typically comprises a retaining ring 115, which is designed to retain the semiconductor wafer 120. The wafer carrier 110 is mounted to a drive motor 130 for continuous rotation about axis $A_1$ in a direction indicated by arrow 133. The wafer carrier 110 is adapted so that a force indicated by arrow 135 is exerted on the semiconductor wafer 120. The CMP apparatus 100 further comprises a polishing platen 140 mounted to a second drive motor 141 for continuous rotation about axis $A_2$ in a direction indicated by arrow 143. A polishing pad 145 formed of a material, such as blown polyurethane, is mounted to the polishing platen 140, which provides a polishing surface for the process.

During CMP, a polishing slurry, which comprises an abrasive material in a colloidal suspension of a chemical solution, is dispensed onto the polishing pad 145. The abrasive material may be amorphous silica or alumina and has a design, i.e., specification, particle size chosen for the material being polished. During CMP, the polishing slurry is pumped onto the polishing pad 145 via a slurry delivery conduit 167.

The CMP apparatus also includes a pad conditioner 180 that conditions the polishing pad 145. During pad conditioning, a conditioning fluid 182 is pumped by a pump 184 from a conditioning source tank 186 to a conditioner delivery conduit 190 onto the polishing pad 145 as a conditioning fluid stream 183. The conditioning fluid 182 contacts the polishing pad 145 at a sufficient contact pressure to cause removal of accumulated materials from the polishing pad. The contact pressure of the conditioning fluid stream 183 may also be selected so that the conditioning fluid stream does not remove portions of the polishing pad 145. If the polishing pad is to be roughened during conditioning, the contact pressure of the conditioning fluid stream 183 may also be selected so that the conditioning fluid stream removes the upper surface of the polishing pad 145. Alternatively, the conditioning fluid stream 183 may impact the polishing pad 145 at a contact pressure between 10 psi (0.70 kg/$cm_2$) to 100 psi (7.03 kg/$cm_2$), or at a contact pressure about 30 psi (2.11 kg/$cm_2$). In other words, the conditioning fluid stream travels at a sufficient velocity so that it removes accumulated particles from the polishing pad 145 as the conditioning fluid stream contacts the polishing pad.

Figure 1B:
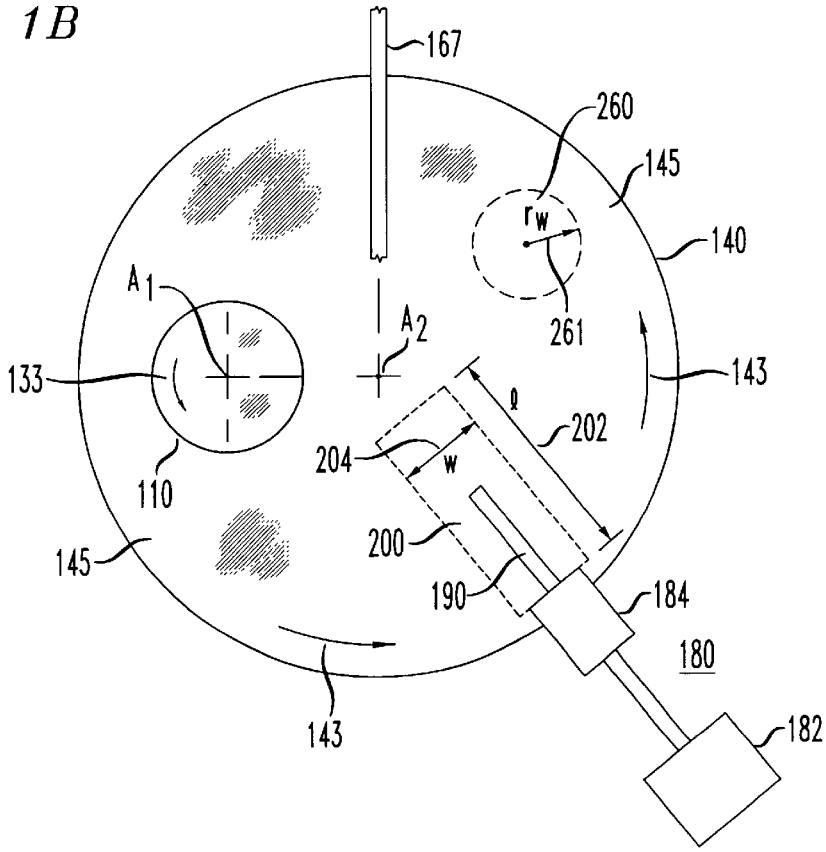
FIG. 1B is a top view of the chemical mechanical planarization (CMP) apparatus shown in FIG. 1A.

Referring now to FIG. 1B with continuing reference to FIG. 1A, illustrated is a schematic plan overhead view of the CMP apparatus of FIG. 1A with the key elements shown. The conditioner delivery conduit 190 has an aperture 192 formed to direct the conditioning fluid over a spray area 200 of the polishing pad 145. The polishing pad is rotated about axis $A_2$ during conditioning so that different portions of the polishing pad 145 pass under the spray area 200. As a result, accumulated particles over the surface of the polishing pad 145 may be removed. After conditioning, the polishing pad 145 is rinsed with, for example, de-ionized water to remove loose materials remaining on the polishing pad.

The velocity of the conditioning fluid stream 183 after it leaves conditioning delivery conduit 190 is depended upon the size and shape of the aperture 192, the size and shape of the conditioner delivery conduit 190, and the pressure of the conditioning fluid in the conditioner delivery conduit 190. Each of these factors may be varied to produce the desired velocity of the fluid stream.

The conditioning fluid 182 may include abrasive particles such as alumina or amorphous silica held in colloidal suspension in the conditioning fluid. The condition particles of alumina or amorphous silica may range in particle size from about 0.012 microns to about 1.5 microns. A person who is skilled in the art will readily appreciate, once reviewing the present disclosure, that other abrasives and other particle sizes may likewise be employed with the present invention. The particle size may be selected so the particle size of the abrasive in the conditioning fluid is as large as or smaller than the particle size of the abrasive in the slurry. In this way, abrasive particles from the conditioning fluid remaining on the polishing pad 145 after conditioning will not scratch the substrate 120 during subsequent polishing. Further, the material forming the abrasive in the conditioning fluid 182 may be selected to be the same as or different than the material forming the abrasive in the slurry. If the materials are the same, damage to the semiconductor wafer 120 during subsequent polishing will be reduced if particles from the conditioning fluid remain on the polishing pad 145.

The conditioning fluid 182 is selected for the particular conditioning process. For example, de-ionized water and amorphous silica may be used as the conditioning fluid to remove accumulated material that resulted from polishing an oxide layer formed on the substrate 120. In addition, fluids containing ferric nitrate or potassium iodate may be the selected as the conditioning fluid. Alternatively, hydrogen peroxide may be the selected as the conditioning fluid if the accumulated materials include metals such as tungsten. Hydrogen peroxide has been found to aid in the removal of accumulated materials containing metals.

With the present invention, the polishing pad 145 may be conditioned more rapidly and more uniformly as the spray area ($A_s$ wl) of the pressurized conditioner greatly exceeds the surface area of a conventional conditioning wheel, shown as area ($A_w$) 260, with a radius ($r_w$) 261. For a representative flat wheel conditioner having the same diameter as an 8 in. (20.32 cm) wafer, the area ($A_w$) 260 is defined as: $A_w=\pi r_w^2$, that is, for $r_w$=4.0 in. (10.16 cm), $A_w$=50.3 in.$^2$ (206.45 cm$^2$). Of course, a ring conditioner configuration would have a significantly smaller area. A representative spray area ($A_s$) 200 having a length (l) 202 of 20 in. (50.80 cm)(the actual spray area may range from about 2 in. (5.08 cm) to about 30 in. (76.20 cm) in length) and a width (w) 204 of 8 in. (20.32 cm) (an actual spray area may range from about 1 in. (2.54 cm) to about 10 in. (25.40) or about 1 in. (2.54 cm) to about 3 in. (7.62 cm) in width) has an area of: $A_s$=160 in$^2$. (1032.26 cm$^2$)

Due to this increased conditioning surface area, the conditioning is effectively spread out over a larger area of the polishing pad 145, which provides for a more consistent conditioning of the pad with fewer variations in the polishing pad's surface. This more consistent conditioning, in turn, provides for a more consistent and controlled polishing action on the semiconductor wafer's targeted surface. The conditioning fluid does not suffer from diamond crystals that wear or fall off as does the materials that fall off a conventional conditioning surface. Therefore, a polishing pad conditioner 100 has been described that increases the effective conditioning area to more uniformly condition a polishing pad while speeding the process.

Figure 2A:
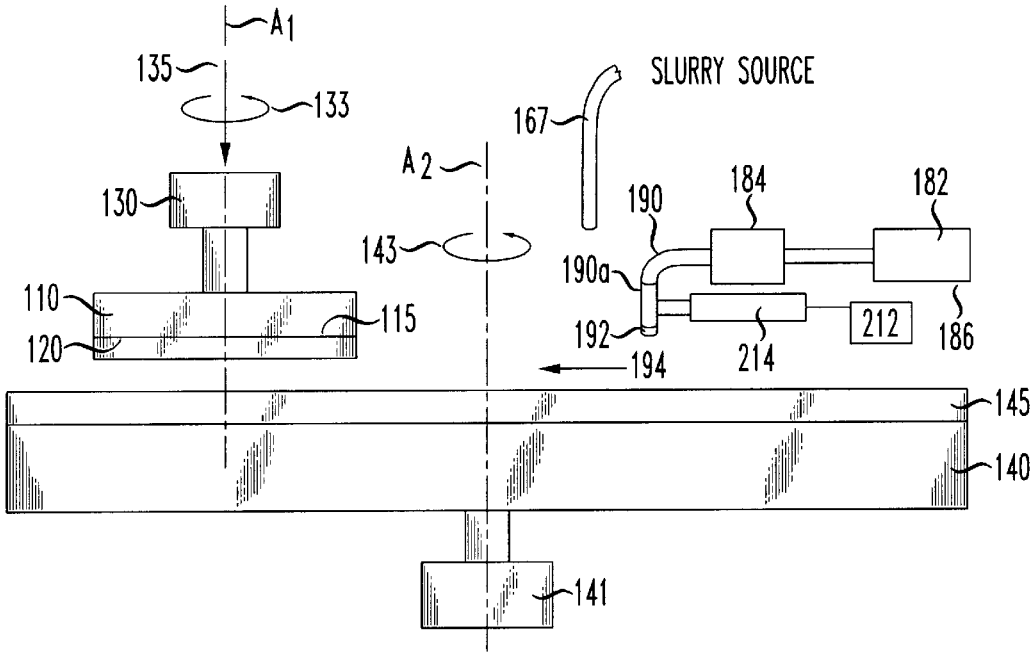
FIG. 2A illustrates is a schematic sectional view of an exemplary embodiment of a chemical mechanical planarization (CMP) apparatus according to another illustrative embodiment of the present invention.
Figure 2B:
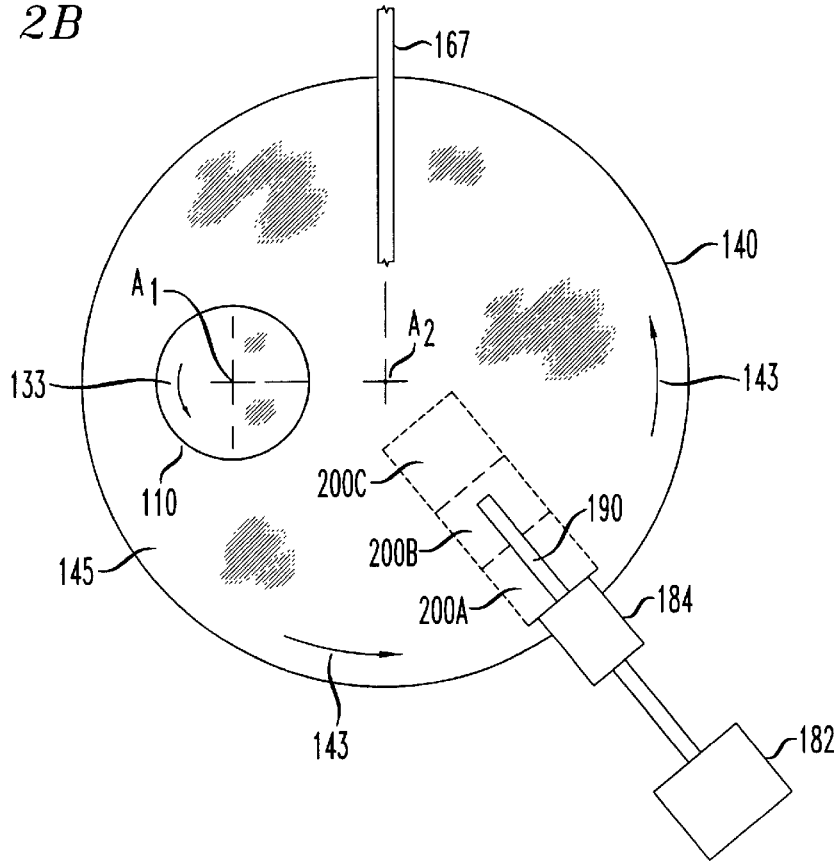
FIG. 2B is a top view of the chemical mechanical planarization (CMP) apparatus shown in FIG. 2A.

In alternative embodiment, as shown in FIGS. 2*a* and 2*b*, the spray area 200*a*, 200*b*, or 200*c* has been reduced as compared to spray area 200. In this case, the conditioner delivery conduit 190 or a segment 190*a* thereof may be moveable so that the spray area 200*a* may be moved relative to the polishing pad 145. The conditioner delivery conduit 190 may be moved using a controller 212 that controls a hydraulic arm 214 coupled to the conditioner delivery conduit 190. The controller is a computer, processor, or other well-known device suitable for controlling the operation of the hydraulic arm 214. The controller 212 contains instructions for actuating the hydraulic arm 214 during conditioning to cause the conditioning fluid stream from the conditioner delivery conduit 190 to be directed to different areas on the conditioning pad. For example, the conditioner delivery conduit 190 may be moved along the path illustrated by arrow 194.

After each rotation or a number of rotations of the polishing pad 145, the conditioner delivery conduit 190 is moved in the direction of arrow 194 by the hydraulic arm 214 to condition a different area of the polishing pad 145. This process is repeated until the polishing ha pad 145 is conditioned. For example, area 200*a* may be conditioned, then area 200*b*, and then area 200*c*. As the polishing pad 145 is rotated, a band corresponding to the areas 200*a*, 200*b*, and 200*c* of the polishing pad 145 is conditioned.

Other mechanisms and movement patterns of the conditioner delivery conduit may be implemented and are within the scope of this invention. For example, instead of moving the conditioner conduit, the entire conditioner system or a subset thereof may be moved relative to the polishing pad 145 to condition the polishing pad.

Figure 3:
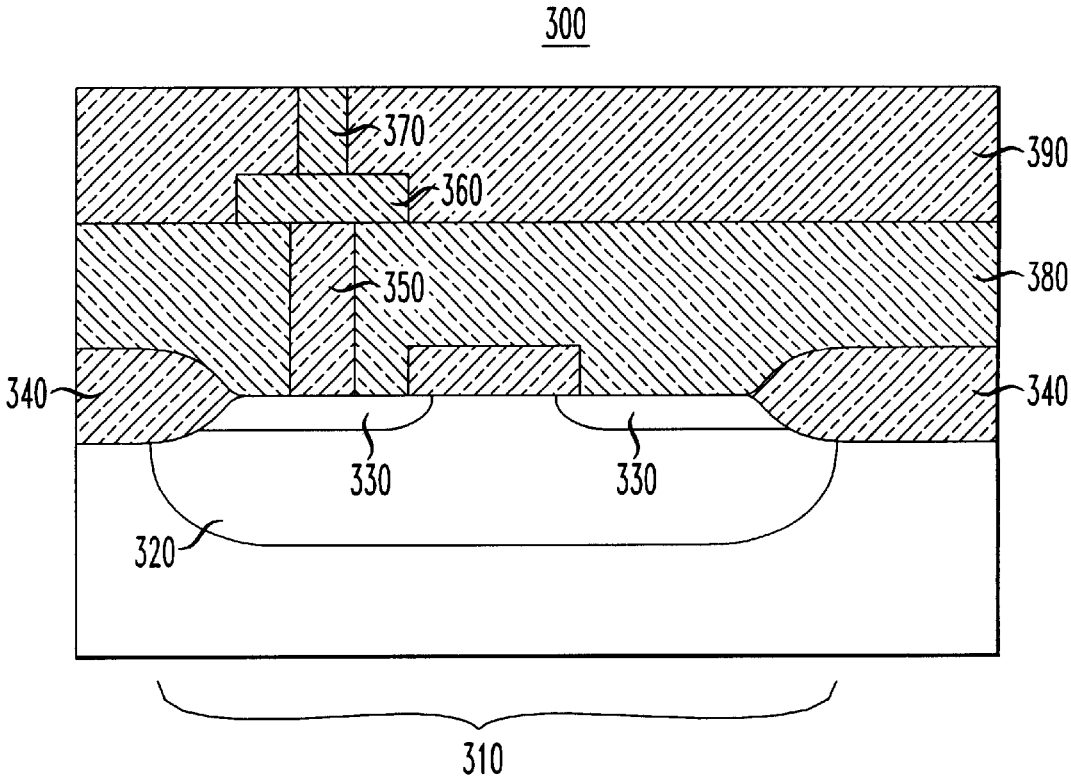
FIG. 3 illustrates a partial sectional view of a conventional integrated circuit that can be manufactured using a polishing pad that has been conditioned in accordance with the present invention.

Referring now to FIG. 3, illustrated is a partial sectional view of a conventional integrated circuit 300 that can be manufactured using a polishing pad that has been conditioned in accordance with the present invention. In this particular sectional view, there is illustrated an active device 310 that comprises a tub region 320, source/drain regions 330 and field oxides 340, which together may form a conventional transistor, such as a CMOS, PMOS, NMOS or bipolar transistor. A contact plug 350 contacts the active device 310. The contact plug 350 is, in turn, contacted by a trace 360 that connects to other regions of the integrated circuit, which are not shown. A contact plug 370 contacts the trace 360, which provides electrical connection to subsequent levels of the integrated circuit. Also included are dielectric layers 380 and 390. For example, dielectric layers 380 and 390 may be planarized using the conditioned polishing pad. Further, contact plugs 350 and 370 may be planarized using a conditioned polishing pad.

Although the present invention has been described in detail, those skilled in the art should understand that they can make various changes, substitutions and alterations herein without departing from the spirit and scope of the invention in its broadest form.

What is claimed is:

1. A method for manufacturing an integrated circuit comprising:

(a) conditioning a pad using a fluid stream that includes first abrasive particles; and (b) polishing a substrate using the conditioned pad and a slurry, the slurry including second abrasive particles, the first abrasive particles having a particle size less than a design particle size of the second abrasive particles.

2. The method of claim 1 wherein the fluid stream includes abrasive particles.

3. The method of claim 2 wherein the abrasive particles include one of amorphous silicon and silica.

4. The method of claim 1 further comprising:

rotating the pad under the fluid stream.

5. The method of claim 1 further comprising:

directing, during step (a), the fluid stream to different areas on the pad.

6. The method of claim 1 wherein the fluid stream strikes the pad at a pressure between 10 psi and 100 psi.

7. The method of claim 6 wherein the pressure is about 30 psi.

8. The method of claim 1 wherein the fluid stream contacts the pad at a velocity sufficient to remove accumulated particles formed on the pad.

9. The method of claim 8 wherein the fluid stream does not remove portions of the pad.

10. The method of claim 8 wherein the fluid stream removes at least a portion of the pad.

11. The method of claim 1 further comprising:

moving the fluid stream relative to the pad.

12. An integrated circuit manufactured according to the process recited in claim 1.

13. A method for conditioning the pad for use in polishing a substrate comprising:

conditioning the pad using a fluid stream having a velocity sufficient to remove accumulated particles formed on the pad, wherein the fluid stream includes first abrasive particles having a particle size less than a design particle size of second abrasive particles included in a slurry used to polish the substrate.

14. The method of claim 13 wherein the fluid stream includes abrasive particles.

15. The method of claim 13 further comprising:

rotating the pad under the fluid stream.

16. The method of claim 13 further comprising:

directing the fluid stream to different areas on the pad.

17. The method of claim 13 wherein the fluid stream strikes the pad at a pressure between 10 psi and 100 psi.

18. The method of claim 13 wherein the fluid stream does not remove portions of the pad.

19. A polishing apparatus comprising:

a pad adapted to polish a substrate; and a pad conditioner adapted to direct a fluid stream at the pad to remove accumulated particles from the pad, wherein the fluid stream includes first abrasive particles having a particle size less than a design particle size of second abrasive particles included in a slurry used to polish the substrate.

20. The polishing apparatus of claim 19 wherein the pad conditioner comprises a moveable conduit adapted to direct the fluid stream at the polishing pad.

* * * * *